US009076318B2

(12) United States Patent
Hawkins

(10) Patent No.: US 9,076,318 B2
(45) Date of Patent: Jul. 7, 2015

(54) DROWNING ALERT TRANSMITTER

(75) Inventor: Jonathan James Hawkins, Didcot (GB)

(73) Assignee: Jonathan James Hawkins, Didcot (GB)

( * ) Notice: Subject to any disclaimer, the term of this patent is extended or adjusted under 35 U.S.C. 154(b) by 862 days.

(21) Appl. No.: 12/921,294

(22) PCT Filed: Mar. 5, 2009

(86) PCT No.: PCT/EP2009/052635

§ 371 (c)(1),
(2), (4) Date: Apr. 13, 2011

(87) PCT Pub. No.: WO2009/109641

PCT Pub. Date: Sep. 11, 2009

(65) Prior Publication Data

US 2011/0187538 A1 Aug. 4, 2011

(30) Foreign Application Priority Data

Mar. 6, 2008 (GB) ..... 0804156.8

(51) Int. Cl.
*G08B 23/00* (2006.01)
*G08B 21/08* (2006.01)

(52) U.S. Cl.
CPC ..... *G08B 21/088* (2013.01)

(58) Field of Classification Search
USPC ..... 340/573.6, 573.1, 539.11, 604, 575; 367/93, 134; 116/211; 2/426
See application file for complete search history.

(56) References Cited

U.S. PATENT DOCUMENTS

| | | | | | |
|---|---|---|---|---|---|
| 4,747,085 | A | * | 5/1988 | Dunegan et al. | 367/93 |
| 4,776,045 | A | * | 10/1988 | Mysliwiec et al. | 2/426 |
| 5,043,705 | A | * | 8/1991 | Rooz et al. | 340/573.1 |
| 5,115,222 | A | * | 5/1992 | Peralta et al. | 340/573.6 |
| 5,408,222 | A | * | 4/1995 | Yaffe et al. | 340/604 |
| 5,923,263 | A | * | 7/1999 | Rodriguez | 340/689.1 |
| 6,064,309 | A | * | 5/2000 | Sellers et al. | 340/573.6 |
| 6,154,140 | A | * | 11/2000 | Thorpe et al. | 340/573.6 |
| 6,157,303 | A | * | 12/2000 | Bodie et al. | 340/573.6 |
| 6,260,508 | B1 | * | 7/2001 | Morse | 116/211 |
| 6,327,220 | B1 | * | 12/2001 | Miller et al. | 367/134 |
| 7,113,097 | B2 | * | 9/2006 | Kline et al. | 340/573.1 |
| 7,642,921 | B2 | * | 1/2010 | Cutler et al. | 340/573.6 |

(Continued)

FOREIGN PATENT DOCUMENTS

| | | | |
|---|---|---|---|
| WO | WO 02/097758 | A | 12/2002 |
| WO | WO 2009/015060 | A | 1/2009 |

OTHER PUBLICATIONS

"Reflections on Lifeguarding Surveillance Programs," Retrieved online from http://www.pia-enterprises.com/reflections.rtf May 18, 2009.

(Continued)

*Primary Examiner* — Benjamin C Lee
*Assistant Examiner* — Israel Daramola
(74) *Attorney, Agent, or Firm* — Lisa M. Warren, Esq.; Morse, Barnes-Brown & Pendleton, P.C.

(57) ABSTRACT

The present invention relates to a drowning alert transmitter comprising: a) a head component 1 for securing on a swimmer's head, b) a head sensor 6A,6B to sense if a swimmer's head is inclined back relative the upper torso and to then generate an alert signal, and c) a transmitter 3 connected to the head sensor to transmit an alarm signal upon generation of an alert signal.

19 Claims, 3 Drawing Sheets

(56) References Cited

U.S. PATENT DOCUMENTS

| | | | | |
|---|---|---|---|---|
| 7,755,494 | B2 * | 7/2010 | Melker et al. | 340/573.1 |
| 2001/0048364 | A1 * | 12/2001 | Kalthoff et al. | 340/573.1 |
| 2003/0210147 | A1 | 11/2003 | Humbard | |
| 2004/0095248 | A1 * | 5/2004 | Mandel | 340/573.6 |
| 2005/0093691 | A1 * | 5/2005 | Kline et al. | 340/539.13 |
| 2005/0093705 | A1 | 5/2005 | Humbard | |
| 2006/0214805 | A1 * | 9/2006 | Boujon | 340/573.1 |
| 2007/0132578 | A1 | 6/2007 | Powell | |
| 2008/0150733 | A1 * | 6/2008 | Snyder et al. | 340/573.6 |
| 2008/0278338 | A1 * | 11/2008 | Krell | 340/573.6 |
| 2009/0027211 | A1 * | 1/2009 | Cutler et al. | 340/573.6 |
| 2009/0295566 | A1 * | 12/2009 | Weintraub | 340/539.11 |

OTHER PUBLICATIONS

Eng et al., "DEWS: A Live Visual Surveillance System for Early Drowning Detection at Pool," *IEEE Transactions on Circuits and Systems for Video Technology 18*(2):196-201(2008).

International Search Report for International Application No. PCT/EP2009/052635, dated Apr. 6, 2009.

* cited by examiner

DROWNING ALERT TRANSMITTER

CROSS-REFERENCE TO RELATED APPLICATIONS

This application is a national stage filing under 35 U.S.C. 371 of International Application PCT/EP2009/052635, filed Mar. 5, 2009, which claims priority to United Kingdom Application No. 0804156.8, filed on Mar. 6, 2008. International Application PCT/EP2009/052635 was published under PCT Article 21(2) in English.

The present invention relates to a transmitter to help alert persons such as lifeguards that a person is drowning.

Many people swim in swimming pools. Occasionally a few swimmers get into difficulty and drown. In public swimming pools, there is often a lifeguard present to look out for persons in difficulty, but in crowded pools it can still be difficult for a trained person to spot a person in difficulty.

The drowning process usually starts when a person starts to panic. The casualty will become vertical in the water and will behave as though they are on a water ladder. The casualty's head will be thrown back in the struggle for air, and the casualty will bob up and down in the water at a frequency of about ¼ Hz. This will go on for a period of about one minute, and the probability of rescue is fast dropping.

The next phase is loss of consciousness lying prone or supine in the water. Water will then flow passively into the casualty's lungs. At this stage it is unlikely a casualty will be revived.

The invention seeks to provide a device which detects when a person enters the panic phase and transmits an alert signal.

According to the present invention there is provided a drowning alert transmitter comprising:

a) a head component for securing on a swimmer's head, b) a head sensor to sense if a swimmer's head is inclined back relative the upper torso and to then generate an alert signal, and c) a transmitter connected to the head sensor to transmit an alarm signal upon generation of an alert signal.

Preferably the head sensor includes at least one accelerometer.

Preferably the drowning alert transmitter further comprises a dipping sensor connected to the head component to sense whether a swimmer's head is dipping in and out of the water and to then generate an alert signal.

Preferably the dipping sensor measures the conductivity or capacitance of water or air between two electrodes.

Preferably the drowning alert transmitter further comprises a movement sensor to sense absence of translational movement of a swimmer through the water and to then generate an alert signal. The movement sensor may include at least one accelerometer.

Preferably the drowning alert transmitter further comprises a water sensor to indicate whether the face of a swimmer is in the water for a prolonged period and to generate an alert signal.

Preferably the head component is a pair of head goggles.

The invention also extends to a drowning alert system comprising the above defined drowning alert transmitter and a receiver to receive alarm signals from the alert transmitter, said receiver providing an indication means that a swimmer is in difficulty on receipt of an alarm signal. The receiver may include means to give directional information of a swimmers location.

An embodiment of the invention will now be described with reference to the accompanying drawings in which:

FIG. 2 shows a schematic circuit diagram, in which

A 3V lithium battery is identified but re-chargeable batteries and possibly other voltages may be used (V+)

Vx is the unsmoothed x acceleration

Vy is the unsmoothed y acceleration

Vx bar over it is smoothed x acceleration

Vy bar over it is the smoothed y acceleration.

Vt is temperature compensation signal

Vw is the water immersion signal. Note that a microcontroller with on board comparator would be used to resolve this signal into water detected/not detected.

Vtdx is signal to the transistor section

There is a heart beat LED included.

Decoupling capacitors for the chips are not shown.

Vint is an interrupt signal from the accelerometer to wake up the microcontroller.

Section A (shown in the bold box describes the water sensor). There will be more than one of these. Examples of where they might be are shown in the diagram of the goggles shown in FIG. 1.

and

Figure 3:
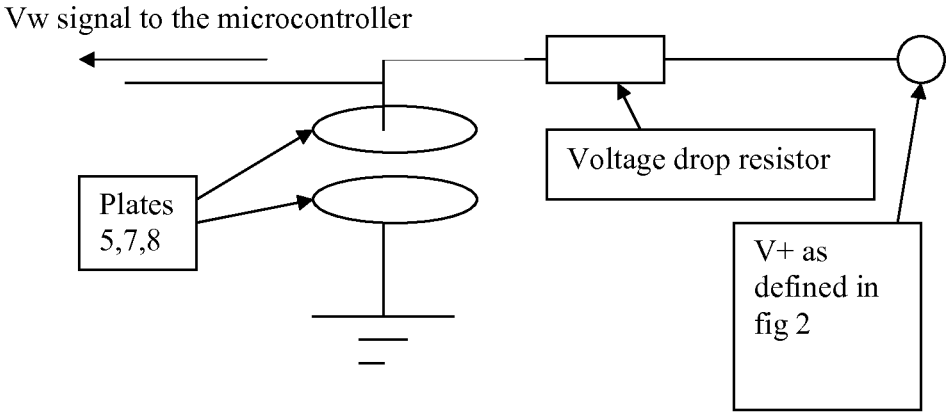

FIG. 3 shows a schematic diagram of a water sensor and circuit.

Figure 1:
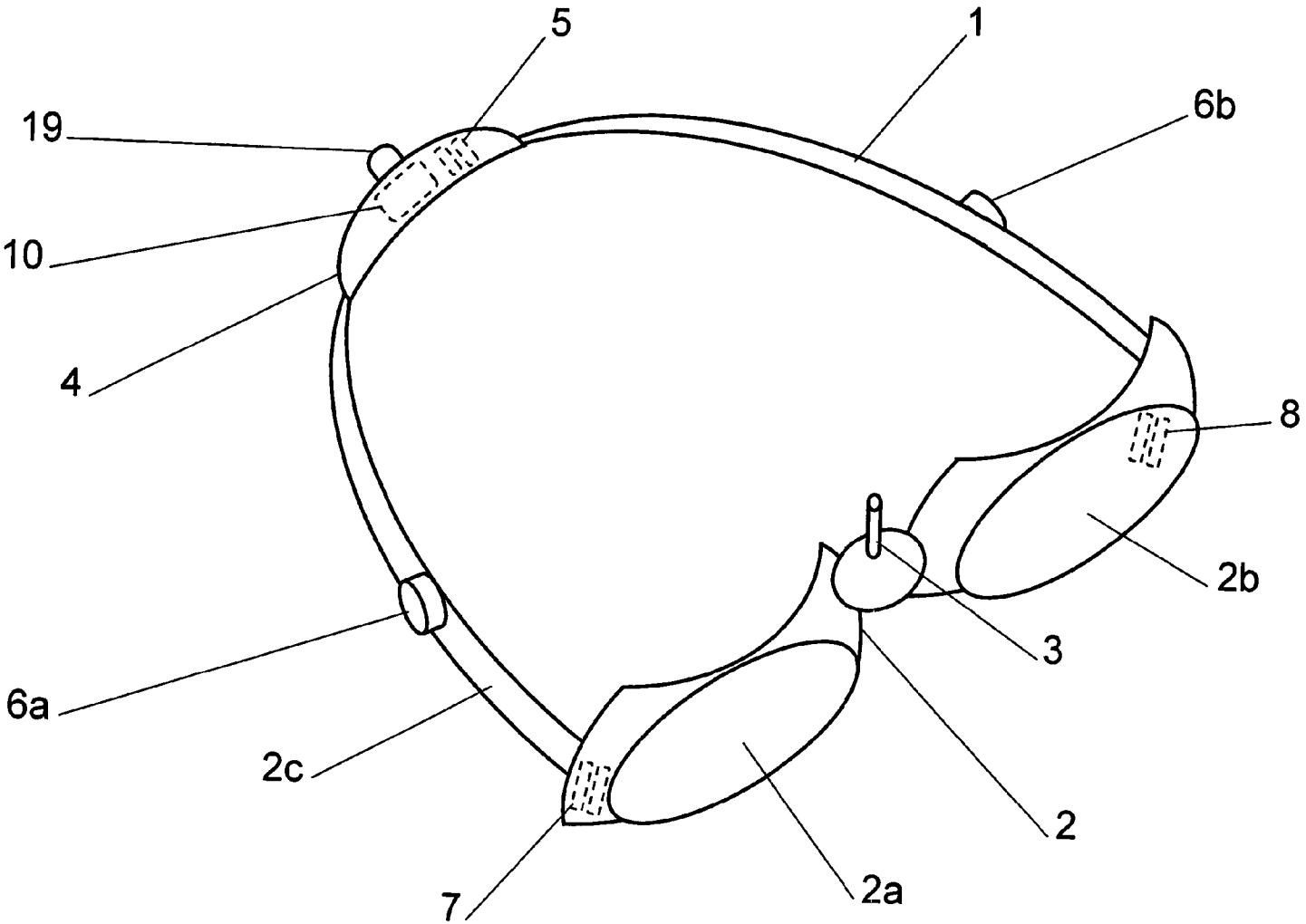
FIG. 1 shows a schematic perspective view of a drowning alert transmitter with the head component in the form of goggles.

Referring to the FIG. 1 there is shown a pair of swimming goggles 1 having a face 2 with pair of lenses 2A,2B, and a strap to pass around the head of a wearer to hold the face 2 over the eyes of the user.

Goggles 1 have a transmitting aerial 3 between the lenses. Goggles 1 also have a housing 4 containing a pair of plates as part of a dipping and water sensor 5, a control circuit 10, and LED 19. Goggles 1 also have a pair of opposing accelerometers 6A, 6B in the strap connected to the control circuit in housing 4. Accelerometers 6A, 6B are adapted to lie just adjacent the front of the ear of a user. Two further dipping and water sensors 7, 8 are provided either side of lenses 2A, 2B. The goggles are adapted to measure seven different conditions which may be associated with drowning as itemised in the table A below:

TABLE A

| Condition | Measured by: | Probability Contribution |
|---|---|---|
| Head inclination indicative of head thrown back gasping for air | Accelerometers | F1 |
| Head submersion. | Pair of Plates | F2 |
| Bobbing. Characteristic bobbing up and down out of the water that a casualty exhibits | Pair of Plates | F3 |
| Translational movement absent. Drowning people are generally vertical in the water | Accelerometers | F4 |
| Jerky movements associated with epilepsy | Accelerometers | F5 |

TABLE A-continued

| Condition | Measured by: | Probability Contribution |
|---|---|---|
| No movement and face down in water for prolonged time (unconscious casualty) | Pair of Plates at the back of the head showing out of water, water sensor at front of head showing underwater (or vice versa) and accelerometers showing face down angle and no movement. | F6 |
| No signal received by receiver for predetermined time i.e. casualty underwater | Transmitter check signal sent every x seconds | F7 |

Figure 2:
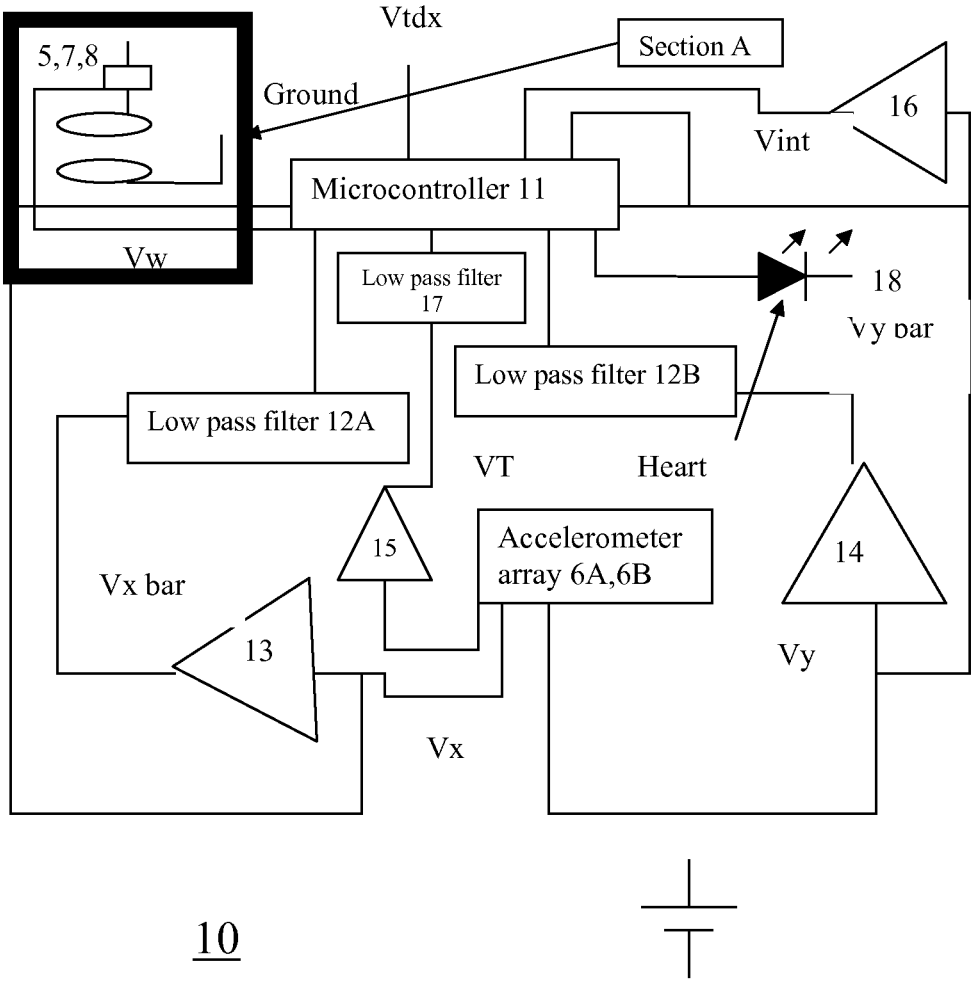

The above defined conditions are monitored by housing 4 with the dipping an water sensor 5, control circuit 10, and LED 19 in housing 4, the accelerometers 6A, 6B, the dipping an water sensors 7, 8 and as shown more fully in the circuit 10 of FIG. 2.

The damped signals Vx and Vy bar from the accelerometers 6A, 6B are orientated in a Cartesian system. Note that more accelerometers and associated amplifiers 13, 14, 15 can be used to give greater definition of head position. The smoothed signals interact with gravity to give inclination of the head from the normal when the detector is placed on the head of the person to be monitored. The immersion detection signal comes from the plates 5, 6, 7 being immersed in water (these plates are strategically placed on the goggles or whatever head garment is used). Vx and Vy are un-damped signal that can be used to detect any movement of the head and report on the possible meaning thereof. The three triangles 13, 14, 15 are amplifiers and the triangle 16 is a comparator (which optionally might be on board the microcontroller). Firmware is written for the controller such that all these attributes are assessed and the likelihood that a swimmer is in difficulty can be assessed. Table A shows how these signals might be assessed. There are five sections to the design of the detector.

Accelerometers

The accelerometers 6A, 6B have functions in the design. Firstly it determines inclination and secondly it gives a signal that is proportional to the acceleration of the body on which it is placed. Both these functions are utilised in this design. An accelerometer actually only measures acceleration but gravity is a constant acceleration. It is this constant acceleration that allows inclination to be measured by a simple triangle of forces principle. The acceleration acting on the accelerometer is $g \cdot \sin \theta$ where theta is the angle of elevation from the normal. This acceleration is constant for a given angle and position and the accelerometer will always record it. The accelerometers are implemented as electronic chips which have an output voltage signal that is proportional to $g \cdot \sin \theta$. This signal, after conditioning, is fed into a microcontroller 11 which interprets the signal as angle. This is how the angle of the head is determined (F1). Practical applications would create an orthogonal array of accelerometers so that all variations in head angle can easily be determined.

The accelerometers are also required to sense acceleration of the body they are attached to, not just the gravity acting upon it. The two signals are actually superimposed but they are separated using the filters described below. The accelerometer measures the acceleration acting on it, whether it is constant gravity or jerky inconstant movements of the human body. The filters 12A, 12B filter out all the fast and inconstant signals associated with body movement leaving a signal that may be interpreted as angle. This signal is fed directly into the microcontroller 11 and interpreted as angle. The unfiltered signal is also fed into the microcontroller 11 and interpreted as body movement. A digital filter is applied (using the software in the microcontroller) to this signal in the form of a high pass filter. This leaves the acceleration of the chip due to its movements rather than those of gravity. This is how the signal F4 is determined.

As shown in the drawing of the goggles water sensors 7, 8 are at the front corners by the lenses and a further water sensor 5 is at the back of the goggles in the housing 4. If the back sensor signals out of water and the front one in, this could be indicative of an unconscious swimmer lying face down in the water. This is how F6 is determined.

Amplification

The signals from the accelerometers 6A, 6B are of limited voltage and hence need to be amplified before they can be fed into the microcontroller analogue to digital converters. Amplifiers 13, 14 are in the above circuit and have Vxbar and Vybar as output signals. Their practical realisation would probably be operational amplifiers. In the circuit there is a third amplifier 15 with a signal designated VT at its output. The accelerometers are often temperature sensitive but there is a signal generated by them which allows this to be compensated for. This signal needs to be amplified and that is what this third amplifier does. Note also that there is a low pass filter 17 on this signal to condition (smooth) it before it is taken into one of the microcontroller analogue to digital channels for interpretation. This signal is used to adjust the read values of Vxbar and Vybar so that they are temperature compensated.

Microcontroller

There are thousands of microcontrollers available on the market, any number of which would suffice for this application. They will read voltages shown by transducers, turn them from analogue to digital signals which then allows the firmware written into the chip (the designer can write any software they chose) to manipulate the data and determine results.

In the case of this circuit Vxbar, Vybar, Vx, Vy and VT are read into the chip and turned into digital signals. Firstly the values are compensated for temperature as explained in the Amplification section. Then Vxbar and Vy bar are compared with a look table which has values of voltage corresponding to angle of inclination. If the values lie within the defined range which corresponds to drowning head inclination then the microcontroller will set a flag corresponding to F1 above. Similarly if the water sensor signal detects immersion it will send a signal to the microcontroller which will cause it to interpret the signal and set a flag corresponding to F2. If this signal has a switching frequency very approximately equal to ¼ Hz it is indicative of bobbing and flag F3 would be set. The signals Vx and Vy are read in the same way and then, if their frequency and duration fits the model for epilepsy, a flag is set which would correspond to F5. Vx and Vy are also used to sense translational movement (noting that an absence of this is a factor that could indicate drowning) and if none is detected flag F4 would be set. The final factor F7 is time based. If rf is used as a transmission medium then it will not travel underwater and if a pair of goggles doesn't give a signal for a predetermined time, say one minute, then there may be an unconscious casualty under the water. This would cause flag F7 to set. Different combinations of these flags are indicative of different risks to the swimmer in question and a summation of all the F factors above a trigger level will signify an issue and cause the microcontroller to set the alert output signal Vtdx shown in the circuit above for transmission of an alarm signal by the transmitter 3.

Heart Beat and Wake Up

Note that the signal Vy is taken put through a comparator shown in yellow and fed into the microcontroller. This signal Vint is a wake up signal if the goggles have not moved for sometime. In order that battery power is saved the electronics in the goggles will shut down if they have not moved for some time, say 10 mins. This signal will be generated immediately that they move and the microcontroller can detect it from sleep mode.

Furthermore the LED 19 in housing 4 shown in the circuit in black is an electronic heart beat. When awake the microcontroller, every 5 seconds or so, makes the LED flash so that a user can tell the detection electronics is working.

Water Sensor

Note: there is only one water sensor shown in the circuit above but a practical application would have at least three (5, 7, 8) positioned as shown in the diagram of the goggles. The water sensor and circuit is shown more fully in FIG. 3. When the water is between the plates is filled with swimming pool water the voltage between them will drop because of the voltage divider that is presented. This drop in signal is detected by an on board comparator in the microcontroller which then causes the microcontroller to set flag F6, F3 or F2.

The invention also extends to a drowning alert system comprising the above defined drowning alert transmitter and a receiver to receive alarm signals from the alert transmitter, said receiver providing an indication means that a swimmer is in difficulty on receipt of an alarm signal. The receiver may include means to give directional information of a swimmers location.

There are a number of standard techniques available for transmitting from the drowning alert transmitter, e.g. to a receiver at the poolside, and this application seeks to leave them all as possibilities. There is also the possibility to signal for help using a bright LED (camera flash). This would signal both lifeguards and other pool users.

Sound transmission is one option because it travels so well under water. Preferably using sonic frequency outside noise bandwidth normally found in pools. For this passive sonar would be required as a receiver. ASK or FSK modulation is envisaged. Multiple receivers would be required to triangulate the signal and hence determine where the person in distress was.

RF transmission is another option because a casualty will periodically lift there head out of the water allowing air transmission. There are microcontrollers with on board RF transmission capability and in combination with an aerial and a few passive components this could be done (rfPIC12F675). This option would be preferred for outdoor activities. Multiple receivers would be required to triangulate the signal and hence determine where the person in distress was. ASK or FSK modulation is envisaged.

The third, probably preferred option for swimming pools is to use infrared (IRLED for example). This would be placed between the eyepieces (or elsewhere if deemed necessary) of the goggles and would transmit to receivers and reflectors suspended from the roof of the swimming pool. The location of the receivers picking up the signal would give away the location of the swimmer in difficulty.

Receiver

Like the transmitters these would use standard technology.

For a transmitter using sonic underwater transmission a series of hydrophones strategically placed around the pool (or activity area) would be necessary. The transmitter signals would be demodulated by poolside electronics and an alarm condition made to activate a warning to the lifeguard or supervisor. It is not envisaged this would activate the main pool alarm, just give a warning to the lifeguards.

For a transmitter using r.f. transmission a series of receiving aerials and receiving electronics strategically placed around the pool (or activity area) would be necessary. The transmitter signals would be demodulated by poolside electronics and an alarm condition made to activate a warning to the lifeguard or supervisor. It is not envisaged this would activate the main pool alarm, just give a warning to the lifeguards.

For a transmitter using visible infrared transmission a series of receivers and reflectors would be strategically placed above the pool (or activity area). The transmitter signals would be demodulated by poolside electronics and an alarm condition made to activate a warning to the lifeguard or supervisor. It is not envisaged this would activate the main pool alarm, just give a warning to the lifeguards. It is probable either ASK or FSK modulation and demodulation would be used.

In addition to the details given above, the drowning alert transmitter of the invention may be used for other purposes by having additional functions given below.

It should be noted that for the transmitter to detect the values below it would need more than one accelerometer. It is envisaged there would be a reset button allowing users to start and stop monitoring the quantities below. The transmitter also detects the following by using the data collected by the accelerometers. The data would download into a computer from a suitable connector on the head component such as goggles.

Lengths. From the acceleration, direction, speed and distance traveled (all available from the on board accelerometer) the transmitter can determine the number of lengths swam, total time in the pool and total time taken swimming aforementioned lengths. For simplicity, it will detect lengths by detecting changes in direction. Since the length of the pool is known the user will easily be able to determine the total distance.

Stroke Dynamics. From the accelerometer the speed, acceleration and distance traveled per stroke will be available. These will be available against time. For example, a plot speed against time (stroke by stroke) can be displayed. The transmitter will also display peak acceleration, max distance traveled by a single stroke, peak velocity and any other dynamic easily obtained from an accelerometer. The head dynamics would also be available. In other words the position the head was in during the swimming process (crucial to achieving a good swimming stroke)

Totals. In addition to the total lengths swam the transmitter will be able to determine total time in the pool, total distance traveled (both whilst swimming and aggregate total).

Software would be written for PC application that would display the above data as graphs. Some data (particularly stroke dynamics) would probably be displayed as relative values rather than absolute values. This would allow the swimmer to assess their performance qualitatively rather than quantitatively.

The invention may take a form different to that specifically described above.

Further modifications will be apparent to those skilled in the art without departing from the scope of the invention.

The invention claimed is:

1. A drowning alert transmitter comprising:

a) a head component for securing on a swimmer's head, b) a head sensor for sensing if the swimmer's head is inclined back relative to the upper torso and then generating an alert signal indicative of drowning, with the head sensor being connected to said head component, for a defined alert signal range corresponding with a range of head inclination indicative of drowning, and c) a transmitter connected to the head sensor to transmit an alarm signal upon generation of said alert signal.

2. A drowning alert transmitter according to claim 1, wherein the head sensor includes at least one accelerometer.

3. A drowning alert transmitter according to claim 1 or 2, further comprising a dipping sensor connected to the head component to sense whether a swimmer's head is dipping in and out of the water and to then generate the alert signal.

4. A drowning alert transmitter according to claim 3, wherein the dipping sensor measures the conductivity or capacitance of water or air between two electrodes.

5. A drowning alert transmitter according to claim 1, further comprising a movement sensor to sense absence of translational movement of a swimmer through the water and to then generate an alert signal.

6. A drowning alert transmitter according to claim 5, wherein the movement sensor includes at least one accelerometer.

7. A drowning alert transmitter according to claim 1, further comprising a water sensor to indicate whether the face of a swimmer is in the water for a prolonged period and to generate an alert signal.

8. A drowning alert transmitter according to claim 1, wherein the head component is a pair of head goggles.

9. A drowning alert system comprising:

an alert transmitter comprising:

a head component for securing on a swimmer's head, a head sensor capable of sensing if the swimmer's head is inclined back relative to the upper torso and then generating an alert signal indicative of drowning for a defined alert signal ranger corresponding with a range of head inclination indicative of drowning, and a transmitter connected to the head sensor to transmit an alarm signal upon generation of the alert signal; and a receiver to receive the alarm signals from the alert transmitter, said receiver providing an indication means that the swimmer is in difficulty on receipt of the alarm signal.

10. A drowning alert system according to claim 9, wherein the receiver includes means to give directional information regarding a swimmer's location.

11. A drowning alert transmitter comprising:

a) a head component for securing on a swimmer's head, b) a head sensor for sensing if the swimmer's head is inclined back relative to the upper torso and then generating an alert signal indicative of drowning, with the head sensor being connected to said head component, for a defined alert signal range corresponding with a range of head inclination indicative of drowning, and c) a transmitter connected to the head sensor to transmit an alarm signal upon generation of said alert signal.

12. A drowning alert transmitter according to claim 11, wherein the head sensor includes at least one accelerometer.

13. A drowning alert transmitter according to claim 11 or 12, further comprising a dipping sensor connected to the head component to sense whether a swimmer's head is dipping in and out of the water and to then generate the alert signal.

14. A drowning alert transmitter according to claim 13, wherein the dipping sensor measures the conductivity or capacitance of water or air between two electrodes.

15. A drowning alert transmitter according to claim 11, further comprising a movement sensor to sense absence of translational movement of a swimmer through the water and to then generate an alert signal.

16. A drowning alert transmitter according to claim 15, wherein the movement sensor includes at least one accelerometer.

17. A drowning alert transmitter according to claim 11, further comprising a water sensor to indicate whether the face of a swimmer is in the water for a prolonged period and to generate an alert signal.

18. A drowning alert transmitter according to claim 11, wherein the head component is a pair of head goggles.

19. A drowning alert system comprising:

an alert transmitter comprising:

a head component for securing on a swimmer's head, a head sensor capable of sensing if the swimmer's head is inclined back relative to the upper torso and then generating an alert signal indicative of drowning for a defined alert signal range corresponding with a range of head inclination indicative of drowning, and a transmitter connected to the head sensor to transmit an alarm signal upon generation of the alert signal; and a receiver to receive the alarm signal from the alert transmitter, said receiver providing an indication means that the swimmer is in difficulty on receipt of the alarm signal.

* * * * *